United States Patent [19]

Kato

[11] Patent Number: 4,935,721

[45] Date of Patent: Jun. 19, 1990

[54] METHOD AND APPARATUS FOR INDICATING A STRIKE AT BOWLING ALLEY

[75] Inventor: Yoshihisa Kato, Tokyo, Japan

[73] Assignee: Tokiwa Trading Co., Ltd., Tokyo, Japan

[21] Appl. No.: 392,321

[22] Filed: Aug. 11, 1989

[30] Foreign Application Priority Data

Aug. 11, 1988 [JP] Japan ..... 63-106336[U]

[51] Int. Cl.[5] ..... G08B 23/00

[52] U.S. Cl. ..... 340/323 B; 340/323 R; 364/410; 364/411; 273/37; 116/222

[58] Field of Search ..... 340/323 R, 323 B; 364/410, 411; 116/222; 273/37, 50, 54 E

[56] References Cited

U.S. PATENT DOCUMENTS 3,728,709 4/1973 McLeod et al. ..... 340/323 B
4,302,010 11/1981 Kaenel ..... 340/323 B
4,339,128 7/1982 Multner ..... 340/323 B

*Primary Examiner*—Donnie L. Crosland
*Attorney, Agent, or Firm*—Browdy and Neimark

[57] ABSTRACT

An apparatus for indicating a strike at bowling alleys has a display board provided with a plurality of displays adapted to show a plurality of symbols thereon, a detector adapted to detect the occurrence of a strike, a microcomputer adapted to determine a several-digit number at random in accordance with an output from the detector, and a lighting circuit adapted to show numerals on the display board in accordance with numeric signals from the microcomputer. The microcomputer outputs random numeric signals successively to the lighting circuit with the microcomputer has received an output from the detector, to show numerals on the display board so that the numerals look as if they were rotated, and the outputting of the numeric signals to the lighting circuit is continued so as to show after the lapse of a predetermined period of time the determined numerals on the displays on the display board in order at predetermined time intervals.

5 Claims, 4 Drawing Sheets

METHOD AND APPARATUS FOR INDICATING A STRIKE AT BOWLING ALLEY

FIELD OF UTILIZATION OF THE INVENTION

This invention relates to a playing apparatus to be installed in a bowling alley, and more particularly to display method and apparatus for operating a display in a bowling alley when a player gets a strike.

PRIOR ART

A conventional automatic pin setter installed at the rear side of a bowling lane in a bowling alley is provided with an apparatus for detecting the knocked-down condition of the pins at the time of completion of a player's first throw of a bowl, and turning on a display when all of the ten pins are knocked down by this bowl, to inform the spectators of the player's getting a strike and celebrate the player. The means used as such a display include a simple lamp adapted to be turned on when a player gets a strike, and an illuminator shaped like a crown and adapted to be turned on when a player gets a strike.

OBJECT OF THE INVENTION

An object of the present invention is to provide novel method and apparatus for indicating a strike having an excellent displaying effect.

EMBODIMENT

Figure 1:
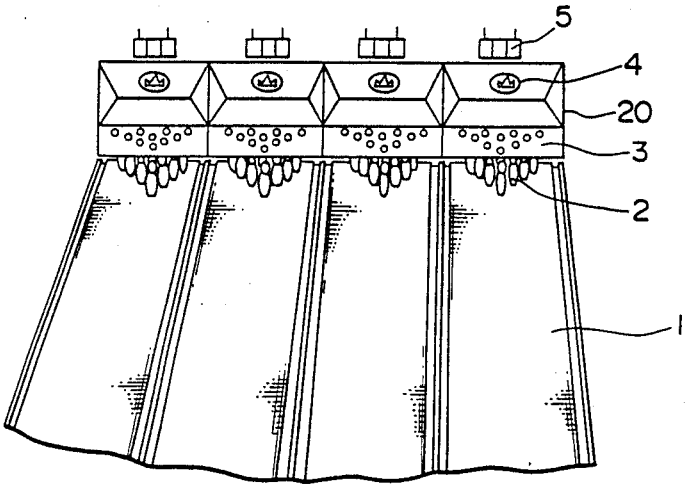
FIG. 1 is a schematic diagram showing bowling equipment provided with display apparatuses according to the present invention.
Figure 2:
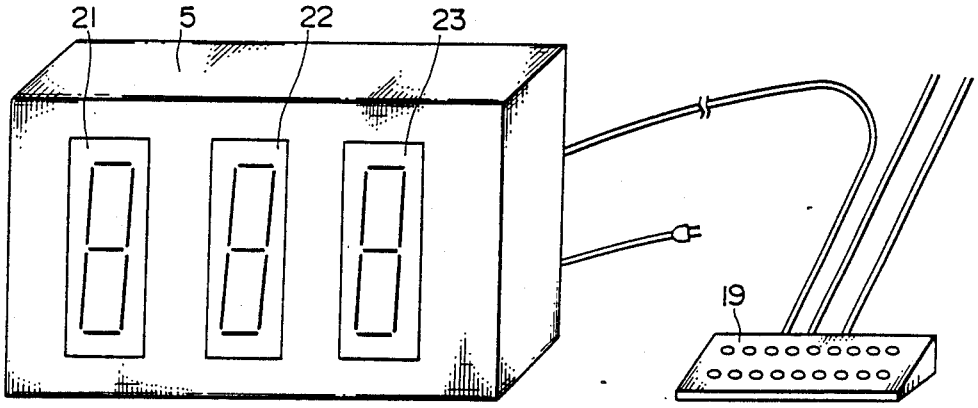
FIG. 2 is a perspective view of a display apparatus according to the present invention.

An embodiment of the present invention will now be described with reference to the drawings. FIG. 1 schematically illustrates a bowling alley. At the upper side of a position on the rear side of a bowling lane 1, a decorative cover 20 is provided, which has an unskittled pin display 3 adapted to show unskittled pins thereon, and a crown-shaped strike display 4 adapted to be lit when all the pins 2 are knocked down by a player's first throw of a bowl. The decorative cover 20 is provided therein with a known automatic pin setter (not shown) adapted to remove the skittled pins from the lane and detect the unskittled pins, by which pin setter the unskittled pin display 3 and strike display 4 are controlled. The above-described arrangement is identical with the conventional corresponding arrangement.

A three-digit numeric display board 5 consisting of three seven-segment displays 21–23 is provided in the vicinity of the decorative cover 20, preferably above the same. This numeric display board 5 is adapted to be operated when the pin setter has detected the occurrence of a strike, and the displayers 21–23 on the display board 5 show random numerals in accordance with an operation of a control unit which will be described later. This numeric display board 5 constitutes the gist of the present invention. What are shown on the display board 5 may consist of not only numerals but also letters, symbols and pictures.

Figure 4:
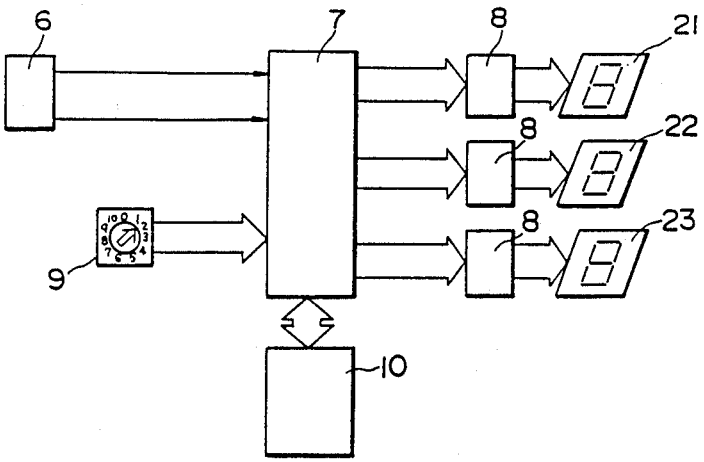
FIG. 4 is a block diagram schematically showing a control circuit.

Referring to FIG. 4, reference numeral 6 denotes a strike detector provided in a known automatic pin setter and adapted to output a control signal to a microcomputer 7 when a strike is detected after a player makes a first throw of a bowl. The strike detector 6 consists of the same part that operates the known strike display 4. Accordingly, when existing bowling equipment is used, the existing detector 6 and microcomputer 7 may be connected together.

The displays 21–23 on the numeric display board 5 are connected to the microcomputer 7 through lighting circuits 8. When the microcomputer 7 receives a strike signal, it carries out two operations. A first operation is an operation for sending out numeric signals to the lighting circuits 8 sequentially at very short time intervals (of about 0.1 sec). This causes the displays 21–23 to show numerals thereon just like a rotating drum in a slot machine. The first operation is carried out for around 5 seconds. A second operation is an operation for determining a three-digit number in accordance with the random numbers contained in the microcomputer 7 and the content of a program memory 10, and output a signal representative of this number to the lighting circuit 8.

Accordingly, when the occurrence of a strike is detected by the detector 6, the displays 21–23 are lit for about five seconds as the numerals shown thereon are varied sequentially. The varying numerals on the left-hand display 21 are then stopped, and one figure of a three-digit number determined in the second operation of the microcomputer 7 is shown on the same display 21. The other determined figures are then shown in order and in a similar manner on the intermediate and righthand displays 22, 23. Owing to such operations, when all the figures in the three-digit number shown on the displays 21–23 agree with one another, a casual handicap can be imposed on the player, or a special favor of fresh competition lure can be granted to the player by adding a bonus score to his present score of recurring number or presenting a prise to him.

A probability regulator 9 capable of regulating a probability that figures constituting a three-digit number shown on the displays 21–23 agree with one another is connected to the microcomputer 7 as necessary. A probability that figures constituting such a three digit number agree with one another is:

$$1/10 \times 1/10 \times 1/10 \times 10 \text{ kinds} = 1\%$$

In some cases, this probability is low due to a small number of bowling games played per day and a low strike-obtaining rate of non-professional bowlers. In such cases, the attractiveness of the present invention is halved. Therefore, the probability regulator 9 is formed so that, in a case where the same numerals appear on the first and second digit indicating displays, the probability that the same numeral be shown on the third digit indicating diaplay can be purposely changed to, for example, 10% when a rotary switch on the probability regulator 9 is set to "1", and 50% when this rotary switch is set to "5". This enables such a probability to be regulated in a range of 10–100%. Accordingly, the probability that the numerals in the first and second places agree with each other is:

$$1/10 \times 1/10 \times 10 \text{ kinds} = 10\%$$

Consequently, when the probability that the numeral in the third place agrees with those in the first and second places is set to 10%, $$10\% \times 10\% = 1\%,$$

and when the probability that the numeral in the third place agrees with those in the first and second places is set to 100%, $$10\% \times 100\% = 10\%$$

Namely, the rate at which three recurring numerals are shown on the display board can be regulated arbitrarily within this range.

A probability regulating operation of the probability regulator 9 is carried out in accordance with a program in the microcomputer 7. An example of the probability regulating operation will be described. When the numerals in the first and second places agree with each other in a case where the probability is set to 50% by the probability regulator 9, a numeral to be shown on the display for the third place is selected up to five times. If the numeral shown on the third display agrees with the other two during this numeral selecting operation, this numeral is displayed.

The above embodiment of the display apparatus according to the present invention is adapted to light the displays only when a strike occurs. The displays may be lit every time a first throw of a bowl is made. In this case, the probability that the same numerals are shown on the displays may be regulated in accordance with the number of the skittled pins 2. The number of digits which can be shown on the display board can be arbitrarily determined. For example, displays for showing a four-digit numeral may be provided. In this case, the regulatable range of probability can be widened by setting regulatable the probability that the same numerals appear in the third and fourth places.

Figure 5:
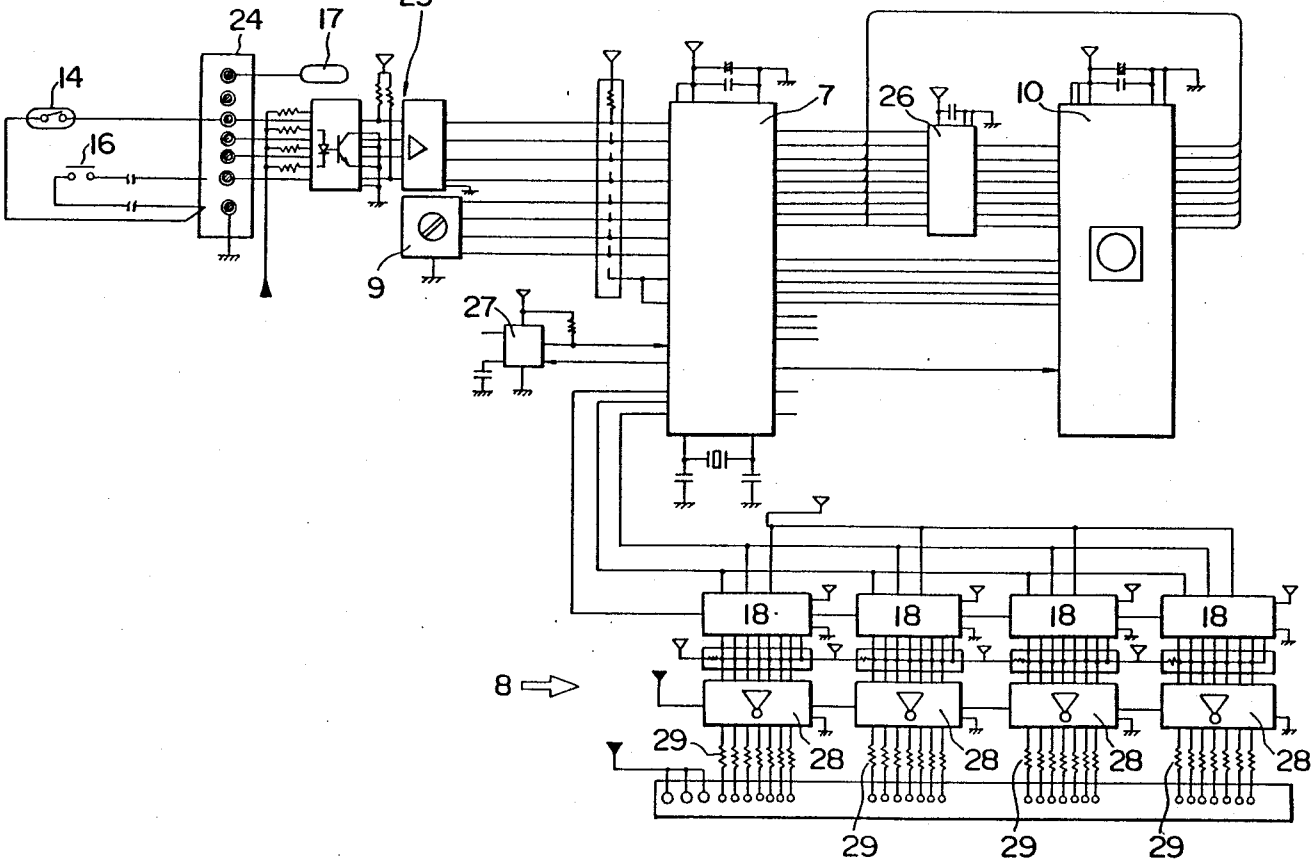
FIG. 5 is a diagram showing the details of the control circuit.
Figure 6:
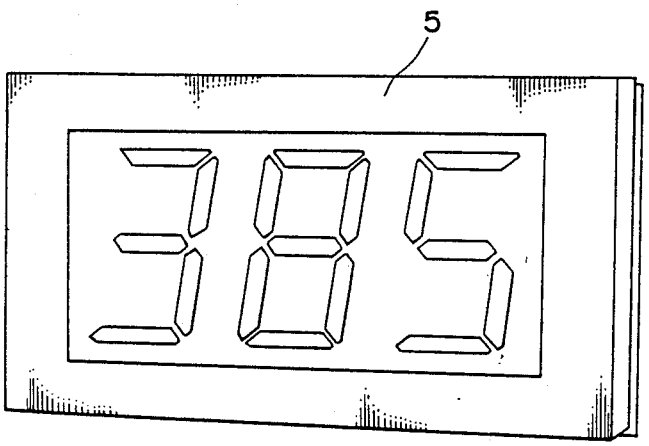
FIG. 6 illustrates a display apparatus in operation according to the present invention.

Referring to FIG. 5, reference numeral 15 denotes a strike switch adapted to be turned on by the strike detector 6, 24 a terminal board, 17 a noise squelching photocoupler, 25 a waveform shaping Schmidt circuit, 26 an address latch, 27 a runaway preventing watch dog timer reset IC, 18 series/parallel converting IC's, 28 transistor arrays, 29 brightness regulating resistors for the displays 21–23, and 16 a reset switch provided in an operator's room or on a reception desk.

Figure 3:
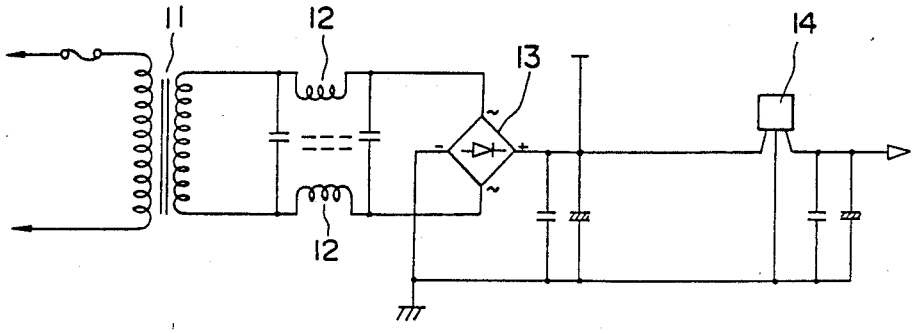
FIG. 3 is a circuit diagram of a power source unit.

Referring to FIG. 3, reference numeral 11 denotes a power source transformer, 12 noise squelching choke coils, 13 a rectifier, and 14 a DC stabilized IC.

The operation of the present invention will now be described.

The displays 21–23 on the numeral display board are normally turned off. When a strike occurs in such a condition, it is detected by the detector 6, and the strike switch 15 is turned on, so that a strike signal is inputted into the microcomputer 7. Consequently, the microcomputer 7 lights the displays 21–23 to show random numerals thereon sequentially so that the numerals on the displays 21–23 look as if they were rotated, and three numerals are determined at the same time in accordance with an output from the probability regulator 9 and the content of the program. When a predetermined period of time (about five seconds) has elapsed after the displays 21–23 showed random numerals sequentially, the rotating numerals on the left-hand display 21 are stopped, and a first numeral is shown thereon. Therefore, in this condition, the numerals on the displays 22, 23 are still rotated. The numerals on the subsequent display 22 are stopped about one second after the numerals on the display 21 are stopped. When about one more second has elapsed, a final numeral is shown on the display 23.

When the same numerals are shown on all the displays owing to these operations, a casual handicap can be imposed on the player, or a special favor of fresh competition lure can be granted to the player by adding a bonus score to his present score of recurring number or presenting a prize to him.

After the numerals on all the displays 21–23 are stopped, they are displayed as they are for about five seconds, and then turned off automatically, so as to improve the displaying effect of the just-shown numerals, obtain the electric power saving effect and prevent the displays from being aged.

EFFECT

According to the present invention described above, a several-digit number is displayed at random when a strike occurs. Therefore, when a several-digit number consisting of the same numerals is shown on the displays, a bonus score can be added to the bowler's present score or a prize can be presented to him. A casual handicap can be imposed upon the bowler who has got a strike, or a special favor of fresh competition lure can be granted to him by presenting goods to him.

I claim:

1. A method for indicating a strike at bowling alleys, comprising the steps of turning on a two-to-four digit number display board when the occurrence of a strike is detected, to show thereon random numbers, which are determined by a microcomputer, in such a manner that said random numbers look as if they were rotated; showing after the lapse of a predetermined period of time predetermined numerals, which are determined in accordance with the random numbers stored in said microcomputer and the content of a program memory, on displays on said display board in order at predetermined time intervals; and turning off said display board when a predetermined period of time has elapsed after predetermined numerals were shown on all of said displays.

2. A method according to claim 1, wherein said display board is adapted to show thereon letters, symbols and pictures.

3. An apparatus for indicating a strike at bowling alleys, comprising a display board having a plurality of displays adapted to show a plurality of symbols thereon, a detector adapted to detect the occurrence of a strike, a microcomputer adapted to determine a several-digit number at random in accordance with an output from said detector, and a lighting circuit adapted to show numerals on said display board in accordance with numeric signals from said microcomputer, said microcomputer outputting random numeric signals successively to said lighting circuit when said microcomputer has received an output from said detector, to show numerals on said display board so that said numerals look as if they were rotated, the outputting of said numeric signals to said lighting circuit being continued so as to show after the lapse of a predetermined period of time said determined numerals on said displays on said display board in order at predetermined time intervals.

4. An apparatus according to claim 3, wherein a probability regulator capable of regulating the probability that the same numerals appear on all of said displays is connected to said microcomputer.

5. An apparatus according to claim 4, wherein said display board is adapted to be lit when a strike occurs, and show numerals thereon, and to be turned off after the lapse of a predetermined period of time.

* * * * *